US006963322B2

(12) United States Patent
Sakaigawa

(10) Patent No.: US 6,963,322 B2
(45) Date of Patent: Nov. 8, 2005

(54) LIQUID-CRYSTAL DISPLAY DEVICE

(75) Inventor: Akira Sakaigawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 277 days.

(21) Appl. No.: 10/252,464

(22) Filed: Sep. 23, 2002

(65) Prior Publication Data

US 2003/0063057 A1 Apr. 3, 2003

(30) Foreign Application Priority Data

Sep. 28, 2001 (JP) ..... P2001-301034

(51) Int. Cl.[7] ..... G09G 3/36

(52) U.S. Cl. ..... 345/87; 345/94; 345/95; 345/96; 345/97

(58) Field of Search ..... 345/84–90, 149, 345/150, 152, 63, 72, 77, 147, 431, 432, 345/94–97, 131; 349/93, 94, 149, 123, 156, 349/129, 132, 133, 49, 34, 61, 74, 432, 33, 349/89, 172

(56) References Cited

U.S. PATENT DOCUMENTS 4,709,995 A * 12/1987 Kuribayashi et al. ..... 345/89
5,061,044 A * 10/1991 Matsunaga ..... 349/133
5,274,484 A * 12/1993 Mochizuki et al. ..... 349/33
5,282,069 A * 1/1994 Sato ..... 349/49
5,347,381 A * 9/1994 Shinomiya et al. ..... 349/134
5,465,169 A * 11/1995 Eguchi ..... 349/124
5,583,534 A * 12/1996 Katakura et al. ..... 345/97
5,639,398 A * 6/1997 Rhee et al. ..... 252/299.01
5,666,173 A * 9/1997 Mase et al. ..... 349/61
5,691,740 A * 11/1997 Onitsuka et al. ..... 345/96
5,818,557 A * 10/1998 Konuma et al. ..... 349/93
5,900,852 A * 5/1999 Tanaka et al. ..... 345/87
5,920,299 A * 7/1999 Ohshima et al. ..... 345/88
5,922,242 A * 7/1999 Saishu et al. ..... 252/299.62
6,133,894 A * 10/2000 Yagyu ..... 345/89
6,392,624 B1 * 5/2002 Yang et al. ..... 345/94
6,417,828 B1 * 7/2002 Sato et al. ..... 345/89
6,727,968 B1 * 4/2004 Bryan-Brown et al. ..... 349/123
2003/0025659 A1 * 2/2003 Kondo et al. ..... 345/87
2003/0206263 A1 * 11/2003 Hinata ..... 349/149

* cited by examiner

*Primary Examiner*—Vijay Shankar
*Assistant Examiner*—Prabodh Dharia
(74) *Attorney, Agent, or Firm*—Robert J. Depke; Trexler, Bushnell, Giangiorgi, Blackstone & Marr

(57) ABSTRACT

In a liquid-crystal display device, one of substrates has pixel electrodes and TFTs for driving the pixel electrodes, and the other substrate has opposing electrodes formed thereon. The orientation of the liquid crystal is controlled to exhibit bistability in which bistable states having different transmittances are maintained when no voltage is applied as a result of applying a voltage exceeding a threshold value, and to exhibit a continuous response characteristic in response to an applied voltage in a predetermined range which does not exceed the threshold value. The voltage applied to the liquid crystal can be selectively controlled between a voltage equal to or higher than the threshold value and a voltage lower than the threshold value, and a two-gradation display using the bistability and a multi-gradation display using the response characteristic are made.

8 Claims, 9 Drawing Sheets

LIQUID-CRYSTAL DISPLAY DEVICE

This application claims priority to Japanese Patent Application Number JP2001-301034 filed Sep. 28, 2001 which is incorporated herein by reference.

BACKGROUND OF THE INVENTION

1. Field of the Invention

The present invention relates to liquid-crystal display devices. More particularly, the present invention relates to a driving method using electro-optical response characteristic and bistability of a liquid crystal.

2. Description of the Related Art

Liquid-crystal display devices have features such as lower weight, thinner structures, and lower power consumption than display devices using CRTs, and are used as monitor displays for portable phones and portable information terminals. There have been strong demands for the displays in portable phones and portable information terminals to be lightweight and thin and to have low power consumption. In particular, in portable phones having a function for displaying information such as characters and symbols even when waiting for a call (at reception waiting time), since a lower power consumption display greatly contributes to the battery life, it is important to develop lower power consumption devices.

Liquid-crystal display devices are broadly classified into transmission types using a backlight and reflection types using reflection of external light. In a transmission-type liquid-crystal display device, since an backlight for illumination is always turned on, the power consumption is large, and therefore the transmission-type liquid-crystal display device is not suitable for display applications of portable devices. At present, reflection-type liquid-crystal display devices which do not require a backlight are mainly used. However, in a reflection-type liquid-crystal display device too, rewriting of the screen is performed periodically at a predetermined frame frequency in an active-matrix technique. For this reason, merely continuing to display a still image and characters consumes a fixed amount of power because the frame is updated, causing the battery lifetime to be shortened. In order to ensure the battery lifetime for future portable devices, which are expected to be increasingly sophisticated, a still more reduction in the power consumption of the display is strongly desired.

Until now, several technologies have been proposed for the problems such as those described above. For example, in Japanese Unexamined Patent Application Publication No. 2000-214466, D. C. Ulrich, et al., Proc. IDW' 00, PLC1–4 (2000) p.293, and J. C. Jones, et al., Proc. IDW' 00, PLC2-2 (2000) p.301, in a liquid-crystal display device with a simple matrix structure, a display mode using bistability of the liquid crystal has been proposed. In this display mode, bistability (memory characteristic) possessed by the liquid crystal itself is used, and the display is maintained even if the applied voltage is removed. Therefore, there is an advantage in that, when a still image is displayed, no power is consumed due to the memory characteristic of the liquid crystal itself. The liquid crystal maintains two states (bistable states) with different transmittances when no voltage is applied, and by using this phenomenon, a two-gradation display of black and white can be made. In addition, if RGB color filters are used in combination, an eight-color display can be made. For example, in a display at a reception waiting time for a portable phone, often, even such a degree of an eight-color display is sufficient, and no power is consumed, thus presenting the advantage in that the battery lifetime can be increased.

However, even for portable devices, there are cases in which higher quality moving images and full-color display are desired. Recent portable phones have functions for browsing Web content and for transmitting/receiving images. In addition, in next-generation portable phone services, transmission and reception of moving images will become possible. Because of such increased functionality, it has become necessary for monitor displays to have higher image quality and to be capable of a full-color display. A two-gradation display is insufficient for such applications, and naturally, full-color multi-gradation displays are necessary for future displays in portable phones and portable information terminals.

SUMMARY OF THE INVENTION

The present invention has been made to solve the above-described problems. An object of the present invention is to provide a liquid-crystal display device suitable for a monitor display in a portable phone and a portable information terminal by ensuring display quality comparable to that of a regular liquid-crystal display device by using a two-gradation display and a multi-gradation display in combination and by achieving lower power consumption. To achieve the above-mentioned object, the present invention provides a liquid-crystal display device comprising a panel having a flat construction and formed of a pair of substrates bonded together with a predetermined spacing therebetween and a liquid crystal held in the spacing, one of the substrates having pixel electrodes arranged in a matrix and switching elements for driving the pixel electrodes formed thereon, and the other substrate having opposing electrodes facing the corresponding pixel electrodes formed thereon; and a driving circuit for driving each switching element in order to write a signal to each pixel electrode, and for applying a voltage corresponding to the signal between the opposing electrode and the pixel electrode to control the transmittance of the liquid crystal, wherein the orientation of the liquid crystal is controlled by the pair of substrates in such a manner that the liquid crystal exhibits bistability such that bistable states having different transmittances are maintained when no voltage is applied and the bistable states can be switched when a voltage exceeding a predetermined threshold value is applied, and exhibits a response characteristic in which the transmittance changes continuously, in response to an applied voltage, in a range which does not exceed the threshold value, and wherein the driving circuit can selectively control the voltage applied to the liquid crystal between a voltage equal to or higher than a threshold value and a voltage lower than the threshold value, and a two-gradation display using the bistability and a multi-gradation display using the response characteristic are made.

Preferably, the orientation control of the liquid crystal is performed by the pair of substrates by making the anchoring strengths thereof with respect to the liquid crystal differ from each other, thus imparting bistability to the liquid crystal. For example, the orientation control of the liquid crystal is performed by the pair of substrates by processing the states of the surfaces thereof in contact with the liquid crystal so as to be different from each other, thus imparting bistability to the liquid crystal. Alternatively, the orientation control of the liquid crystal is performed by the pair of substrates by forming different orientation films on the surfaces thereof in contact with the liquid crystal, thus imparting bistability to the liquid crystal. Furthermore, the driving circuit switches the electrical potential of the opposing electrode in order to selectively control a voltage to be applied to the liquid crystal between a voltage equal to or higher than a threshold value and a voltage lower than the threshold value. Alternatively, the driving circuit may switch the amplitude of a signal to be written into the pixel electrode in order to selectively control the voltage to be applied to the liquid crystal between a voltage equal to or higher than a threshold value and a voltage lower than the threshold value. Furthermore, the liquid crystal shows a nematic phase whose orientation is controlled in the horizontal direction by the pair of substrates. In addition, the liquid crystal shows a twisted nematic phase in which the orientation is twisted between the pair of substrates.

In the liquid-crystal display device according to the present invention, a liquid crystal having both an electro-optical response characteristic and bistability is used for a display medium. This liquid crystal is active-matrix-driven by active elements such as pixel electrodes and thin-film transistors arranged in a matrix. At this time, the voltage to be applied to the liquid crystal is changed so as to be capable of selectively making a multi-gradation display using the normal electro-optical response characteristic and a two-gradation display using bistability. In the multi-gradation display, by combining with a color filter, a multi-color display close to a full-color display is possible. Furthermore, in the two-gradation display using bistability, since there is memory characteristic, the display is maintained even if the applied voltage is removed. In this manner, the present invention realizes a multi-gradation display capable of a multi-color display and a two-gradation display having a memory characteristic with a single liquid-crystal display device, and can appropriately switch between the two displays according to the display mode.

As has thus been described, according to the present invention, an active-matrix liquid-crystal display device has characteristics such that a liquid-crystal layer exhibits bistability, a threshold value exists in bistable switching of the liquid crystal, and the liquid-crystal layer is memorized at one of the stable positions at a voltage equal to or higher than the threshold voltage. As a result, the display can be maintained even if the electric field is removed, and the power consumption can be made almost zero when a still image which does not require rewriting of the screen is displayed. On the other hand, when the device is driven at a voltage equal to or lower than the threshold voltage, since gradation display is possible, it is possible to display a full-color image. It is easy to switch between these two modes at a voltage to be applied without newly adding elements. Use of such a liquid-crystal display device allows the power consumption of portable phones and portable information terminals to be reduced and allows the battery lifetime to be increased.

DESCRIPTION OF THE PREFERRED EMBODIMENT

Figure 1A:
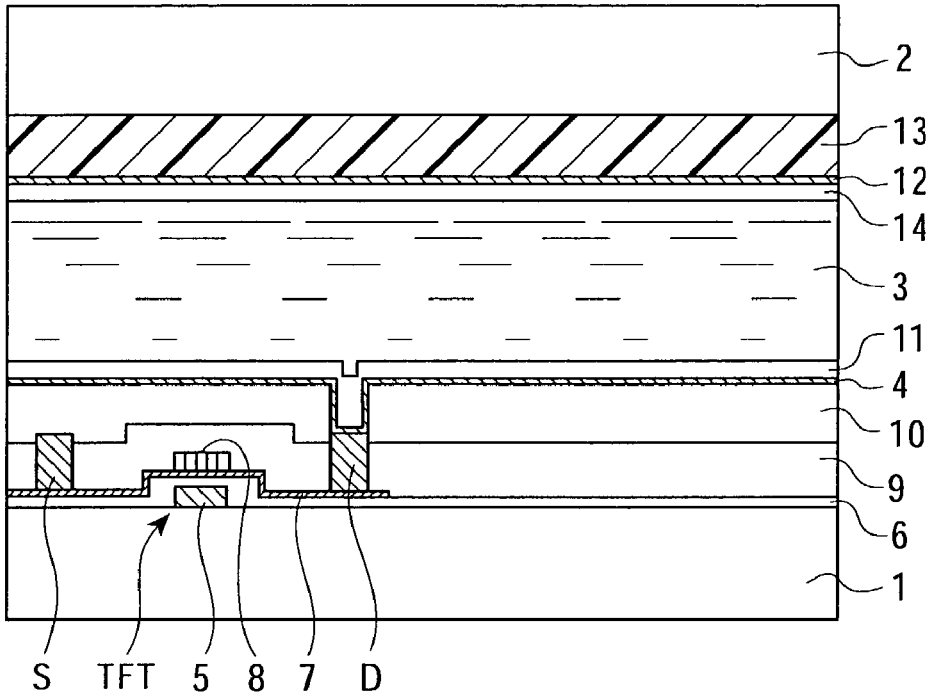
FIGS. 1A and 1B are schematic views showing the configuration and operation of a liquid-crystal display device according to the present invention.
Figure 1B:
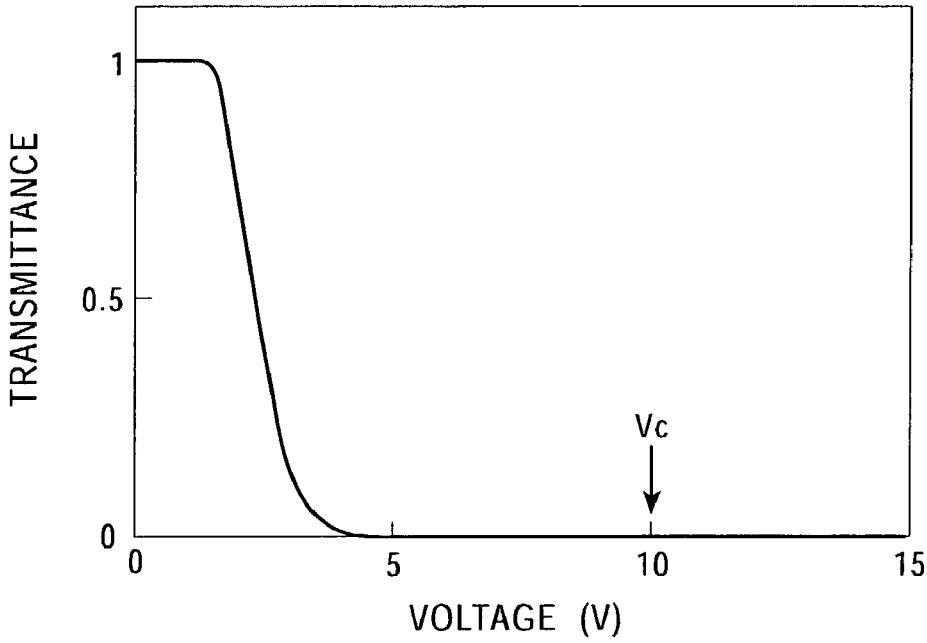

An embodiment of the present invention will be described below in detail with reference to the drawings. FIG. 1A is a schematic partial sectional view showing the basic configuration of a liquid-crystal display device according to the present invention. FIG. 1B is a graph showing the relationship between the voltage applied to the liquid crystal and transmittance. The graph shown in the figure is only an example, and the voltage-transmittance characteristic of the liquid crystal and the threshold voltage vary according to the type of liquid crystal material, the degree of anchoring at the orientation surface, etc. First, as shown in FIG. 1A, this liquid-crystal display device has a flat construction formed of a pair of substrates 1 and 2 bonded together with a predetermined spacing therebetween and a liquid crystal 3 held in the spacing. One of the substrates 1 has pixel electrodes 4 arranged in a matrix and switching elements for driving these pixel electrodes. In this embodiment, the switching elements are formed of thin-film transistors (TFTs). Each TFT is composed of a gate electrode 5, a gate insulating film 6 formed thereon, and a semiconductor thin film 7 made from polycrystalline silicon formed thereon. The portion of the semiconductor thin film 7 positioned just above the gate electrode 5 forms a channel area. This channel area is protected by a stopper 8. A source region and a drain region are provided on the two sides of the channel area, respectively. The TFT having such a construction is covered with an interlayer insulating film 9, and on the interlayer insulating film 9, a source electrode S and a drain electrode D are formed using aluminum by patterning. Although the source electrode S is not shown in the figure, it is connected to a signal wiring line. The gate electrode 5 is connected to a gate wiring line. The drain electrode D is connected to the above-mentioned pixel electrode 4. A planarizing layer 10, which is used to fill the irregularities on the substrate, is formed between the TFT and the pixel electrode 4. The pixel electrode 4 is covered with an orientation layer 11.

The other substrate 2 has an opposing electrode 12 facing each pixel electrode formed thereon. In addition, a color filter 13, which has three colors RGB in each pixel element, is also formed. An orientation film 14 is formed on the surface of the opposing electrode 12.

This liquid-crystal display device comprises, in addition to the above-described panel having a flat construction, a driving circuit for driving the panel. Although this driving circuit is not shown in the figure, there are cases where this driving circuit is built into the panel and cases where it is provided externally. The driving circuit drives the switching elements formed of TFTs in order to write a signal into each pixel electrode 4, and applies a voltage corresponding to the signal between the opposing electrode 12 and the pixel electrode 4 to control the transmittance of the liquid crystal 3, thereby forming a desired image display.

FIG. 1B shows an applied voltage/transmittance characteristic of the liquid crystal 3. The graph shown is only an example, and the voltage/transmittance characteristics of the liquid crystal and the threshold voltage may vary depending on the type of liquid-crystal material, the degree of anchoring on the orientation surface, etc. The applied voltage/transmittance characteristic shows a moderate curve at a voltage equal to or lower than a predetermined threshold voltage Vc, indicating that a multi-gradation display by voltage modulation is possible. When the applied voltage is 0, the transmittance is 1, and a white display can be obtained. When the applied voltage is increased from 0 V up to 5 V, the transmittance is gradually decreased, and the display changes from a gray display to finally a black display. By using such a nonlinear electro-optical response characteristic and by writing a gradation signal through a switching element such as a TFT provided in each pixel electrode, a multi-gradation display can be obtained. Furthermore, by storing the signal electrical charge in an auxiliary capacitor provided in parallel with each pixel electrode, the display can be maintained until the next frame period. In this manner, in this liquid-crystal display device, in an operating region equal to or lower than the threshold voltage Vc, a normal active-matrix operation is performed to make a multi-gradation display possible. By combining the multi-gradation display and the color filter 13, a multi-color display close to a full-color display is possible.

When the applied voltage is 0 V, the transmittance of the liquid crystal is 100%, and a white display is formed. This corresponds to one of the bistable states. When the applied voltage is increased from 0 V, the transmittance becomes 0% at 5 V, and a black display is formed. Even if the applied voltage is increased further, the electro-optical response characteristic of the liquid crystal remains saturated. In addition, if the applied voltage is made to be equal to or higher than the threshold voltage Vc, a phase change occurs in the orientation state of the liquid crystal 3, and the state shifts to a second stable state. The transmittance of this second stable state is 0 (black display), and this state has a memory characteristic. That is, even if the applied voltage is removed, the second stable state is maintained, and the state will not return to the above-described first stable state. The liquid crystal 3 has the first stable state (white display) and the second stable state (black display). The two states can be switched by applying a voltage exceeding the threshold voltage Vc. When the black display is switched to the white display, a negative-polarity voltage is applied. Such a response characteristic and bistability of the liquid crystal is due to the orientation state of the liquid crystal 3. The orientation state of the liquid crystal 3 is controlled by a pair of upper and lower orientation layers 11 and 14.

In the manner described above, in the liquid crystal 3, the bistable states having different transmittance when no voltage is applied can be maintained, and these bistable states can be switched by applying a voltage exceeding the predetermined threshold voltage Vc. Furthermore, the liquid crystal 3 has a response characteristic such that the transmittance varies continuously in response to an applied voltage in a predetermined range which does not exceed the threshold voltage Vc. The orientation state of the liquid crystal 3 is controlled by a pair of substrates 1 and 2 so that the above-described bistability and response characteristic are exhibited. The features of the present invention are such that the driving circuit of the panel can selectively control the voltage applied to the liquid crystal 3 between a voltage equal to or higher than the threshold voltage Vc and a voltage lower than the threshold voltage Vc, and thus a two-gradation display using bistability and a multi-gradation display using a normal response characteristic can be selectively performed. For example, the driving circuit switches the electrical potential of the opposing electrode 12, and selectively controls the voltage applied to the liquid crystal 3 between a voltage equal to or higher than the threshold voltage Vc and a voltage lower than the threshold voltage Vc. Alternatively, the driving circuit may selectively control the voltage applied to the liquid crystal 3 between a voltage equal to or higher than a threshold value and a voltage lower than the threshold voltage Vc by switching the amplitude of the signal written to the pixel electrode 4.

For the pair of upper and lower substrates 1 and 2, orientation control is performed in such a manner that the anchoring strengths with respect to the liquid crystal 3 differ from each other, thereby imparting bistability to the liquid crystal 3. For example, for the pair of substrates 1 and 2, orientation control is performed in such a manner that the states of the surfaces with respect to the liquid crystal 3 differ from each other, thereby imparting bistability to the liquid crystal 3. Specifically, for the pair of substrates 1 and 2, orientation control is performed in such a manner that orientation films 11 and 14, which differ from each other, are formed on the surfaces in contact with the liquid crystal 3, thereby imparting bistability to the liquid crystal 3. The liquid crystal 3 exhibits a nematic phase which is controlled to be horizontally oriented by the orientation films 11 and 14 formed on the pair of substrates 1 and 2, respectively. More specifically, the liquid crystal 3 exhibits a twisted nematic phase such that the orientation is twisted between the pair of substrates 1 and 2.

Figure 2A:
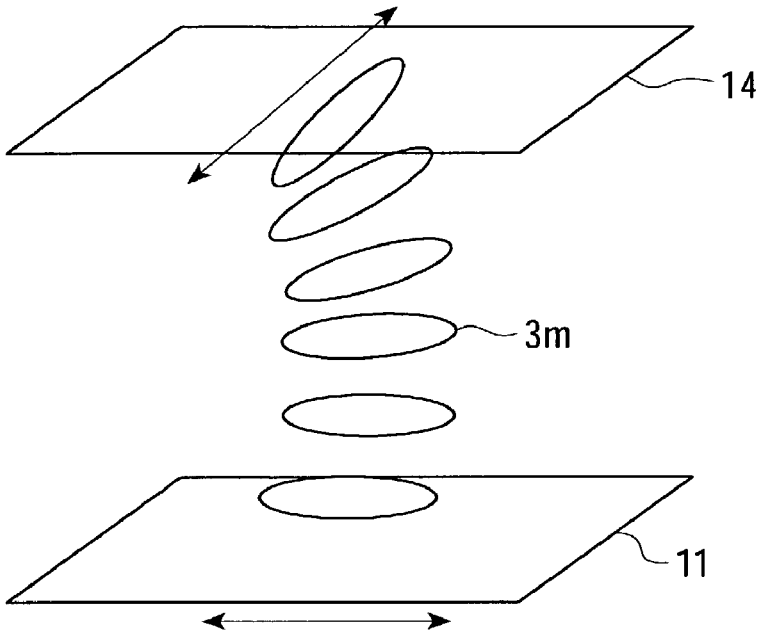
FIGS. 2A and 2B are schematic views showing orientation states of a liquid crystal.
Figure 2B:
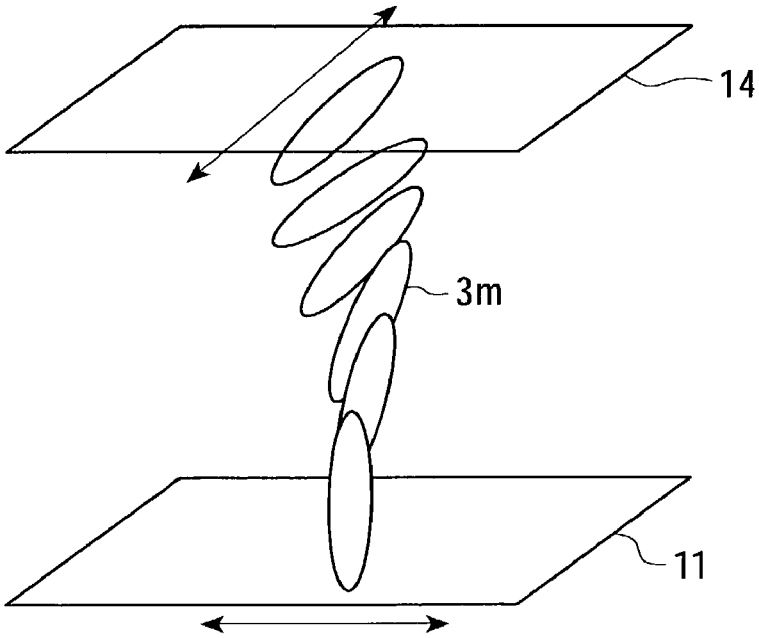

FIGS. 2A and 2B schematically show orientation states of the liquid crystal. FIG. 2A shows an orientation state when no voltage is applied, which is a first stable state. As shown in this figure, liquid-crystal molecules 3*m* are placed in a so-called twisted orientation by a pair of upper and lower orientation films 11 and 14. The nematic liquid-crystal molecules 3*m* are subjected to horizontal orientation control by one of the orientation layers 11. Furthermore, the liquid-crystal molecules 3*m* are similarly horizontally oriented by the other orientation film 14. However, the directions of the horizontal orientations on the upper and lower orientation films 11 and 14 intersect at right angles with each other. As a result, the liquid-crystal molecules 3*m* are twisted by 90 degrees while being horizontally oriented. Such a first stable state in combination with a pair of polarizers in a crossed-Nicol configuration makes it possible to obtain a white display.

FIG. 2B shows a state in which the voltage is increased from the first stable state (initial state) shown in FIG. 2A to reach a second stable state. When the applied voltage is increased, the liquid-crystal molecules 3*m* tilt in the electric-field direction against the regulating force (anchoring) of the orientation films 11 and 14. However, since the anchoring strength of the orientation film 11 at the lower side is weaker than the anchoring strength of the orientation film 14 at the upper side, the liquid-crystal molecules 3*m* positioned on the lower portion tilt in response to the applied voltage, whereas the liquid-crystal molecules 3*m* in contact with orientation film 14 at the upper side cannot tilt since they are strongly anchored. As the applied voltage is increased, the liquid-crystal molecules 3*m* tilt more, and when the threshold value is exceeded, the liquid-crystal molecules 3*m* are freed from the regulating force of the orientation film 11 at the lower side and are tilted substantially vertically. When freed from the anchoring once, even if the applied voltage is released, the molecules will not return to the horizontal orientation again, and memory characteristic appears. In this second stable state, since the twisted orientation is lost, when the display is observed with a pair of polarizers in a crossed-Nicol configuration, a black display is obtained.

The liquid crystal used in the present invention has a characteristic such that, when a voltage equal to or higher than a particular threshold voltage Vc is applied, the liquid crystal memorizes a stable position. When the liquid crystal memorizes a stable position, the stable state is maintained even if the electric field is removed. Then, by applying an opposite-polarity voltage equal to or higher than the threshold voltage Vc, the liquid crystal can return to the initial state. That is, it is possible to realize bistable states formed of an initial state at an applied voltage 0 and a memory state in a case where a voltage equal to or higher than a threshold voltage is applied. In order to realize such bistable states, the anchoring strengths of the pair of orientation films 11 and 14, which oppose each other, are made to differ from each other. By causing the orientation film 11 positioned on one of the substrate interface to have weak anchoring and by causing the orientation film 14 positioned on the other substrate interface to have strong anchoring, a stable state such as that shown in FIG. 2B exists. This state is a memory state which is maintained even if the electric field is removed. Therefore, if the polarizer is disposed in such a manner that the first stable state shown in FIG. 1A becomes a white display, the second stable state shown in FIG. 2B becomes a black display, and thus a binary black-and-white display is possible. If an RGB color filter is combined with this, an eight-color display is possible. As a method of varying the anchoring strengths of the orientation films 11 and 14, the type of orientation film may be different. Alternatively, the rubbing strength for the orientation film may be different. Alternatively, the surface shapes of the orientation films may be different from each other. For example, by forming a grating on the surface of one of the orientation films, bistable orientation can be realized.

Figure 3A:
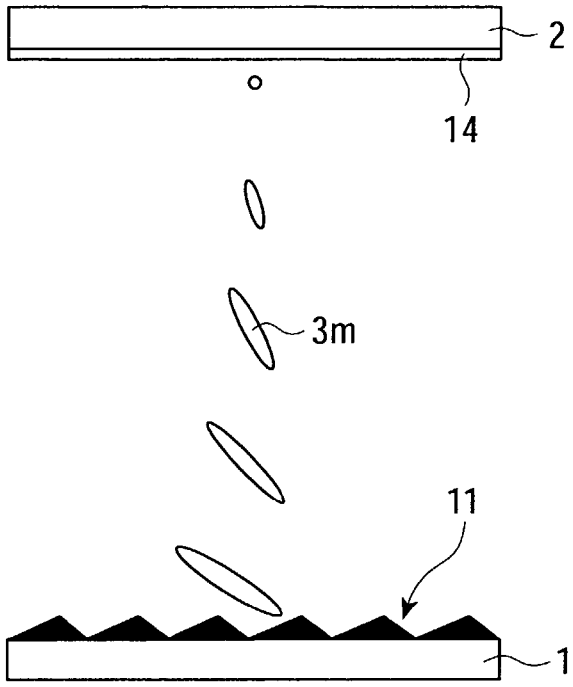
FIGS. 3A and 3B are schematic views showing orientation states of a liquid crystal.
Figure 3B:
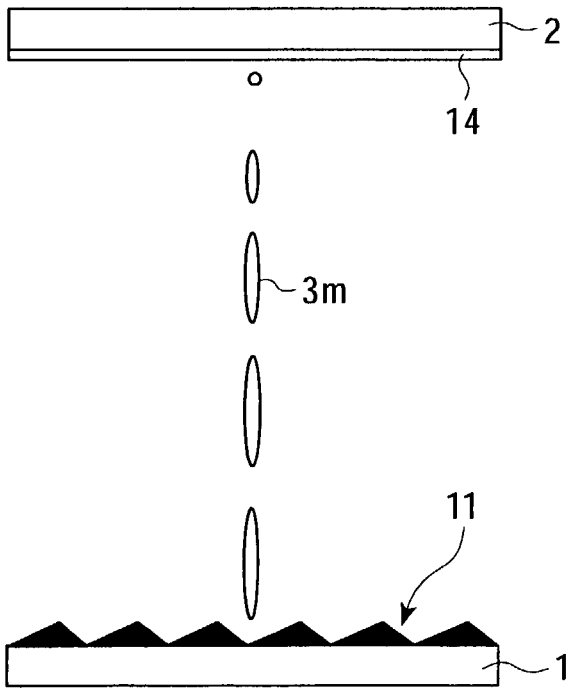

FIGS. 3A and 3B are schematic views showing orientation control of a liquid crystal. For ease of understanding, the portions in FIGS. 3A and 3B corresponding to those in FIGS. 2A and 2B are given the same reference numerals. On the inner surface of a substrate 2 at the upper side, an orientation film 14 which exhibits normal horizontal orientation (homogeneous orientation) is formed. For example, after a polyimide resin coating is applied, a rubbing treatment is performed thereon to obtain the desired homogeneous orientation. The orientation of the liquid-crystal molecules 3*m* is controlled horizontally along the rubbing direction. In the example shown in the figure, the rubbing direction is perpendicular to the plane of the drawing. On the other hand, the orientation film 11 having a grating is formed on a substrate 1 at the lower side. This orientation film 11 can be formed in such a manner that, for example, after a photosensitive resin coating is applied, an exposure/development process is performed with a predetermined mask pattern. The liquid-crystal molecules 3*m* are inclined by a relatively small tilt angle along this grating. The inclination direction is parallel to the plane of the drawing.

FIG. 3B shows that the state has changed to the second stable state as a result of an applying a voltage exceeding the threshold value. The liquid-crystal molecules in contact with the orientation film 14 at the upper side cannot escape from the anchoring, and remain homogeneously oriented. In contrast, the liquid-crystal molecules 3*m* in contact with the orientation film 11 at the lower side become freed from the anchoring and move to a vertically orientation state. When the liquid-crystal molecules 3*m* are freed from the anchoring (regulating force) of the orientation film 11, even if the voltage is removed, the liquid-crystal molecules 3*m* will not return to the original inclined orientation state. In this manner, by inclining the liquid-crystal molecules 3*m* at a relatively small tilt angle by using the grating, bistable states can be realized. For the liquid-crystal material, a nematic liquid crystal is preferably used. Use of a nematic liquid crystal makes it possible to form a full-color display with analog gradation at a driving voltage equal to or less than the threshold value. At an applied voltage equal to or higher than the threshold value, a full-color display by analog gradation is possible. At a driving voltage equal to or higher than the threshold value, a memory state is reached. In particular, it is preferable that a twisted-nematic liquid crystal be used so that the orientation of the liquid-crystal molecules 3*m* is twisted between the upper and lower substrates 1 and 2. The liquid-crystal display device of the present invention may be either a transmission type or a reflection type. Alternatively, a semi-transmission type in which a transmission type and a reflection type are combined may be used.

Figure 4A:
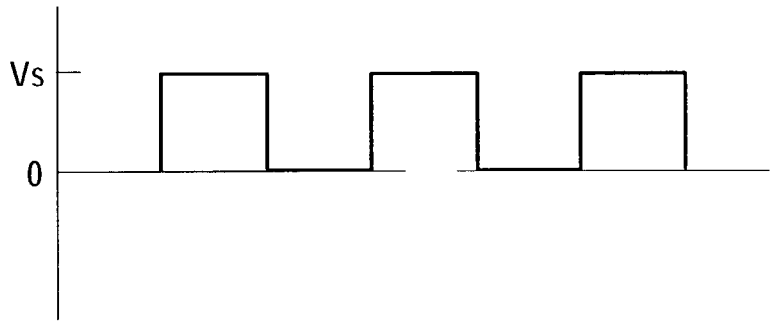
FIGS. 4A, 4B, and 4C are waveforms illustrating the operation of the liquid-crystal display device according to the present invention.
Figure 4B:
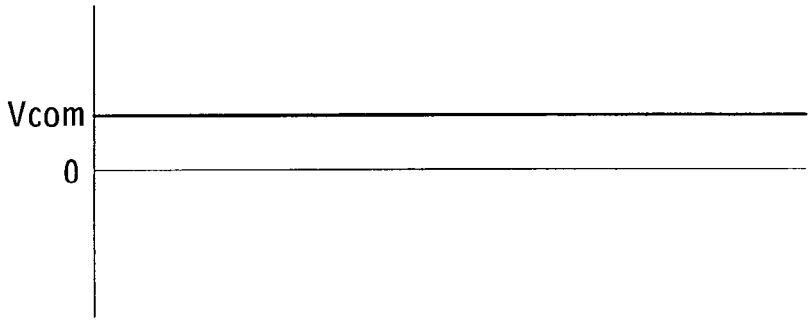
Figure 4C:
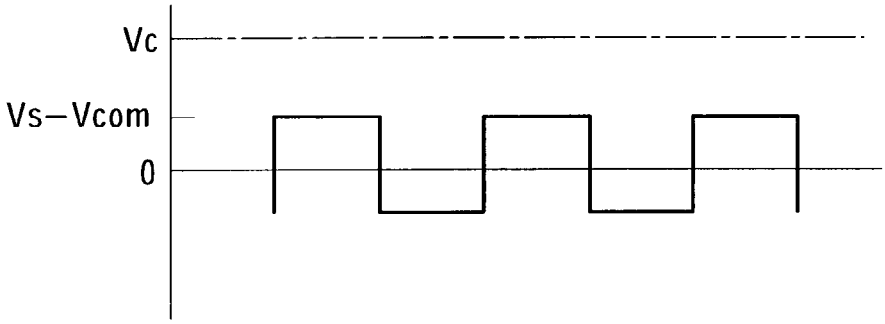

FIGS. 4A, 4B, and 4C are waveforms illustrating the operation of the liquid-crystal display device according to the present invention, and, in particular, show a multi-gradation display mode using the normal electro-optical response characteristic or a continuous gradation display mode. FIG. 4A shows a signal voltage waveform Vs which is applied to the pixel electrode. FIG. 4B shows a voltage waveform Vcom which is applied to the opposing electrode. FIG. 4C shows a voltage waveform which is actually applied to the liquid crystal between the pixel electrode and the opposing electrode. By controlling the voltage in a range in which the amplitude Vs-Vcom does not exceed the threshold voltage Vc, a normal continuous gradation display is possible. That is, it is possible to control the transmittance of each pixel according to the level of the applied voltage Vs-Vcom.

Figure 5A:
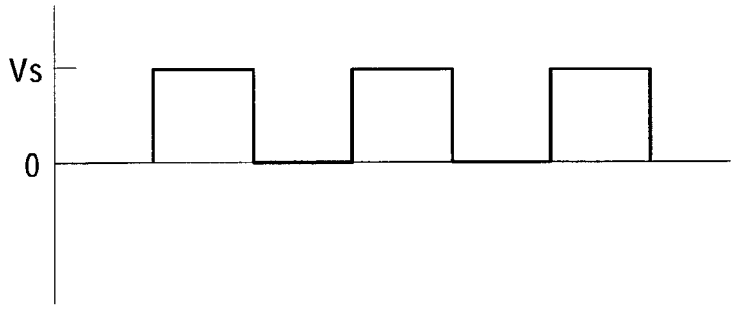
FIGS. 5A, 5B, and 5C are waveforms illustrating the operation of the liquid-crystal display device according to the present invention.
Figure 5B:
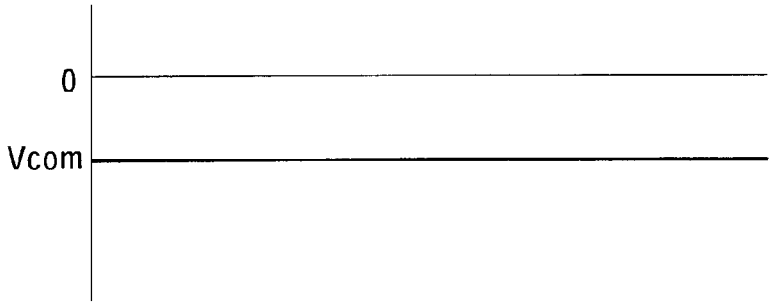
Figure 5C:
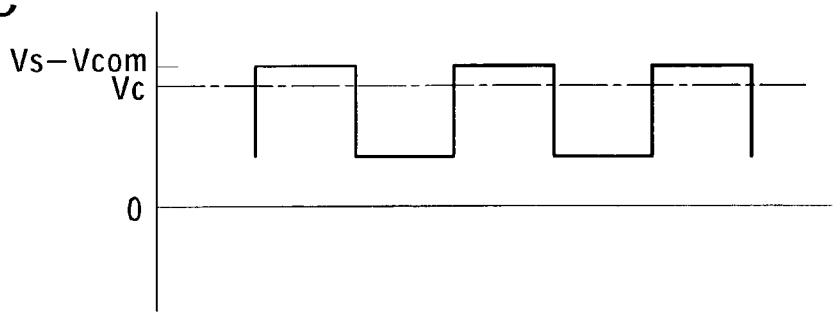

FIGS. 5A, 5B, and 5C are waveforms showing a driving method using the bistable states. For ease of understanding, the portions in FIGS. 5A, 5B, and 5C corresponding to those in FIGS. 4A, 4B, and 4C are given the same reference characters. As shown in FIG. 5A, the signal voltage to be applied to each pixel electrode is the same as that of the normal driving method using a response characteristic. As shown in FIG. 5B, the voltage to be applied to the opposing electrode is greatly shifted toward the negative-polarity side in comparison with the case of FIG. 4B. As a result, as shown in FIG. 5C, the voltage Vs-Vcom which is actually applied to the liquid crystal exceeds the threshold voltage Vc. In a case where Vcom is greatly varied in this manner and Vs-Vcom becomes higher than Vc, the liquid crystal shifts to the memory state. By setting the value of Vcom to an appropriate voltage, only pixels to which a signal voltage exceeding a fixed Vs is applied can be shifted to the memory state.

Figure 6A:
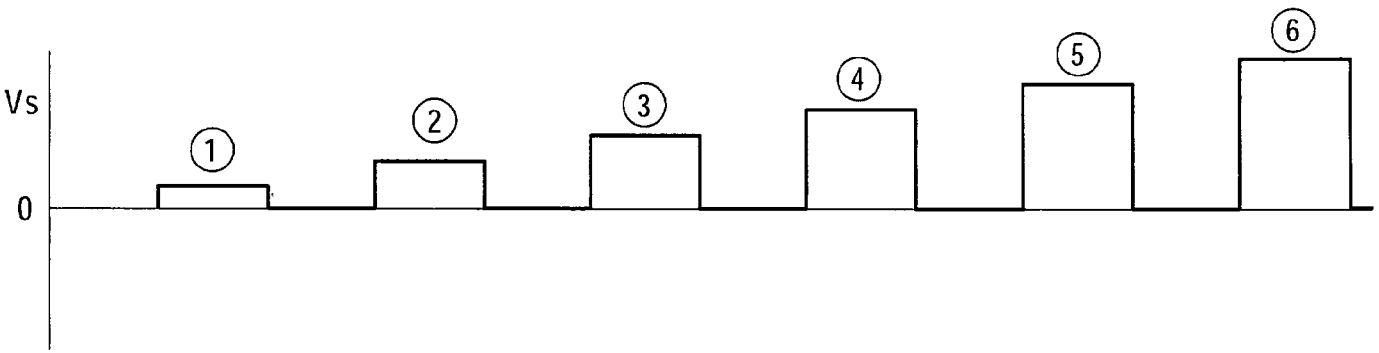
FIGS. 6A, 6B, and 6C are waveforms illustrating the operation of the liquid-crystal display device according to the present invention.
Figure 6B:
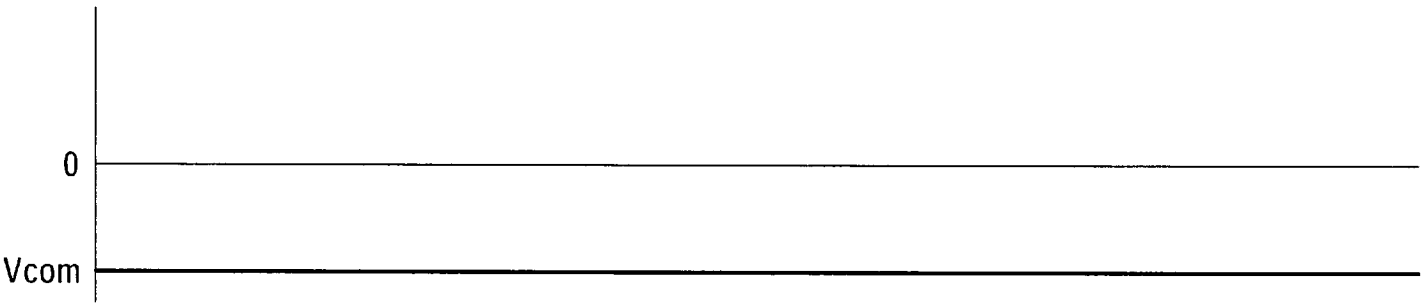
Figure 6C:
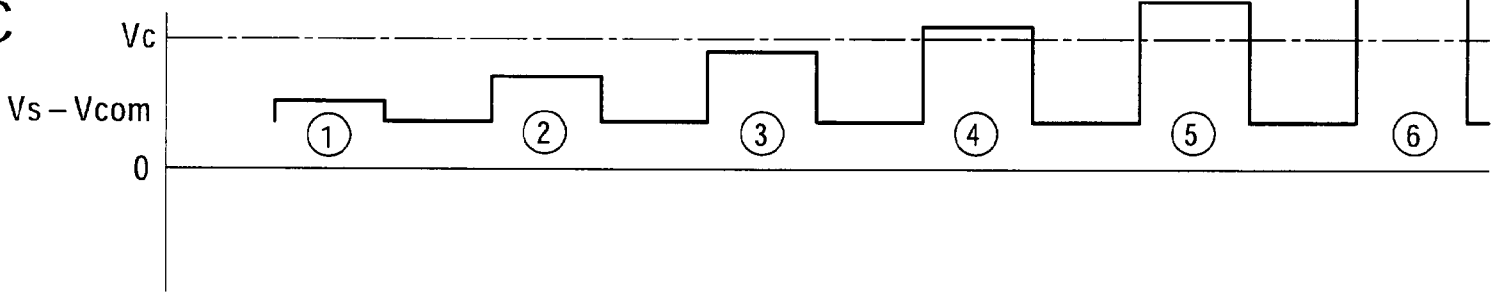

FIGS. 6A, 6B, and 6C are waveforms illustrating a developed form of the method of driving a liquid-crystal display device according to the present invention. For ease of understanding, the portions in FIGS. 6A, 6B, and 6C corresponding to those in FIGS. 4A, 4B, and 4C and FIGS. 5A, 5B, and 5C are given the same reference characters. In FIG. 6A, signal voltages of different levels are applied to the corresponding pixels indicated by (1) to (6). In the example shown in the figures, control is performed in such a manner that the signal voltage level increases from pixel (1) to pixel (6). FIG. 6C shows the actual voltage levels applied to the pixels (1) to (6). The voltages applied to the pixels (1) to (3) do not exceed the threshold voltage Vc, and the voltages applied to the pixels (4) to (6) exceed the threshold voltage Vc.

Figure 7A:
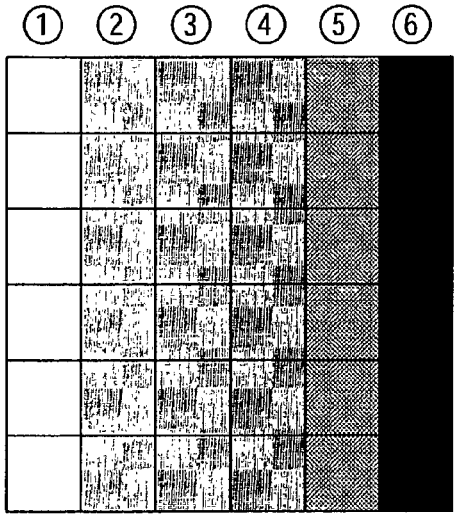
FIGS. 7A and 7B are waveforms illustrating the operation of the liquid-crystal display device according to the present invention.
Figure 7B:
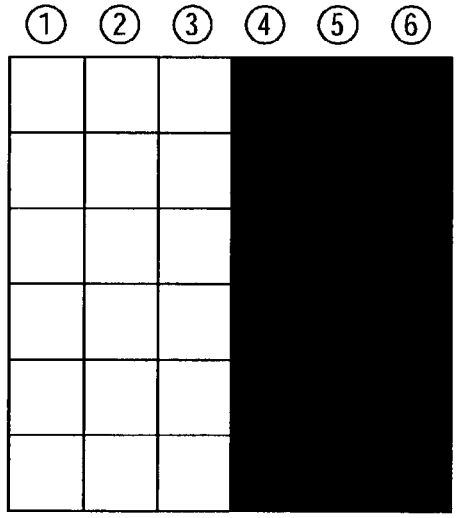

FIGS. 7A and 7B show the luminance of each pixel. FIG. 7A shows the case of a multi-gradation display using normal response characteristic. The luminance of each of the pixels (1) to (6) changes in sequence from white, to gray, and to black according to the level of the signal voltage.

In contrast, FIG. 7B shows the luminance of the bistable states. In the pixels (1) to (3), since the applied voltage does not exceed Vc, a white display which is a first stable state is formed, whereas, in the pixels (4) to (6), since the applied voltage exceeds Vc, a black display which is a second stable state is formed. This black-and-white binary display is maintained even if the applied voltage is removed. On the other hand, the multi-gradation display containing the gray-scale shown in FIG. 7A disappears when the applied voltage is removed. In this manner, by setting the value of Vcom to an appropriate voltage, only the pixels to which a signal voltage exceeding a particular fixed Vs is applied can be changed to the memory state. That is, a particular fixed gradation level or higher of an image can be formed into a memory state. Multi-bit to two-bit conversion can be easily performed. Use of such a driving method makes it possible to easily switch between a full-color display by multi-gradation and an 8-bit display using two gradation.

Figure 8A:
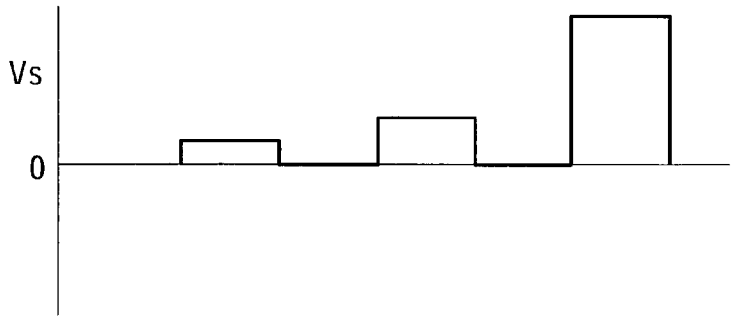
FIGS. 8A, 8B, and 8C are waveforms illustrating the operation of the liquid-crystal display device according to the present invention.
Figure 8B:
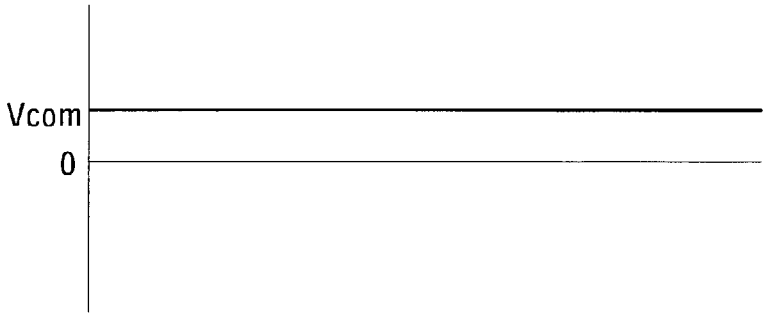
Figure 8C:
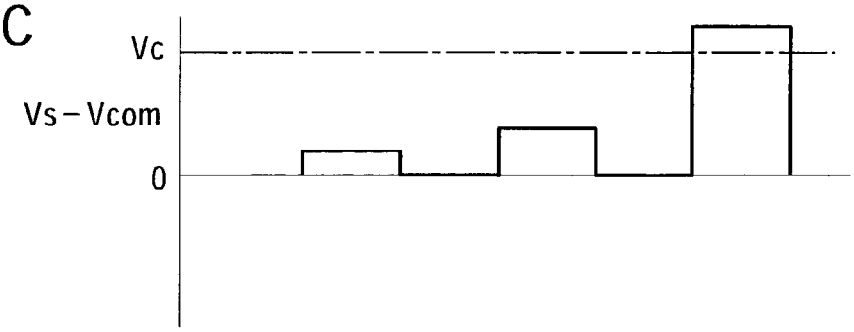

FIG. 8A, 8B, and 8C are waveforms showing a method of driving a liquid-crystal display device according to the present invention. For ease of understanding, portions in FIG. 8A, 8B, and 8C corresponding to those in FIGS. 4A, 4B, and 4C are given the same reference characters. In this example, by varying the level Vs of the signal voltage to be applied to each pixel electrode, it is possible to switch between driving using normal response characteristic and driving using bistability. In this driving method, the signal voltage to be applied to a specific pixel is set to a large value so that the applied voltage of the liquid crystal becomes equal to or higher than the threshold value.

Figure 9:
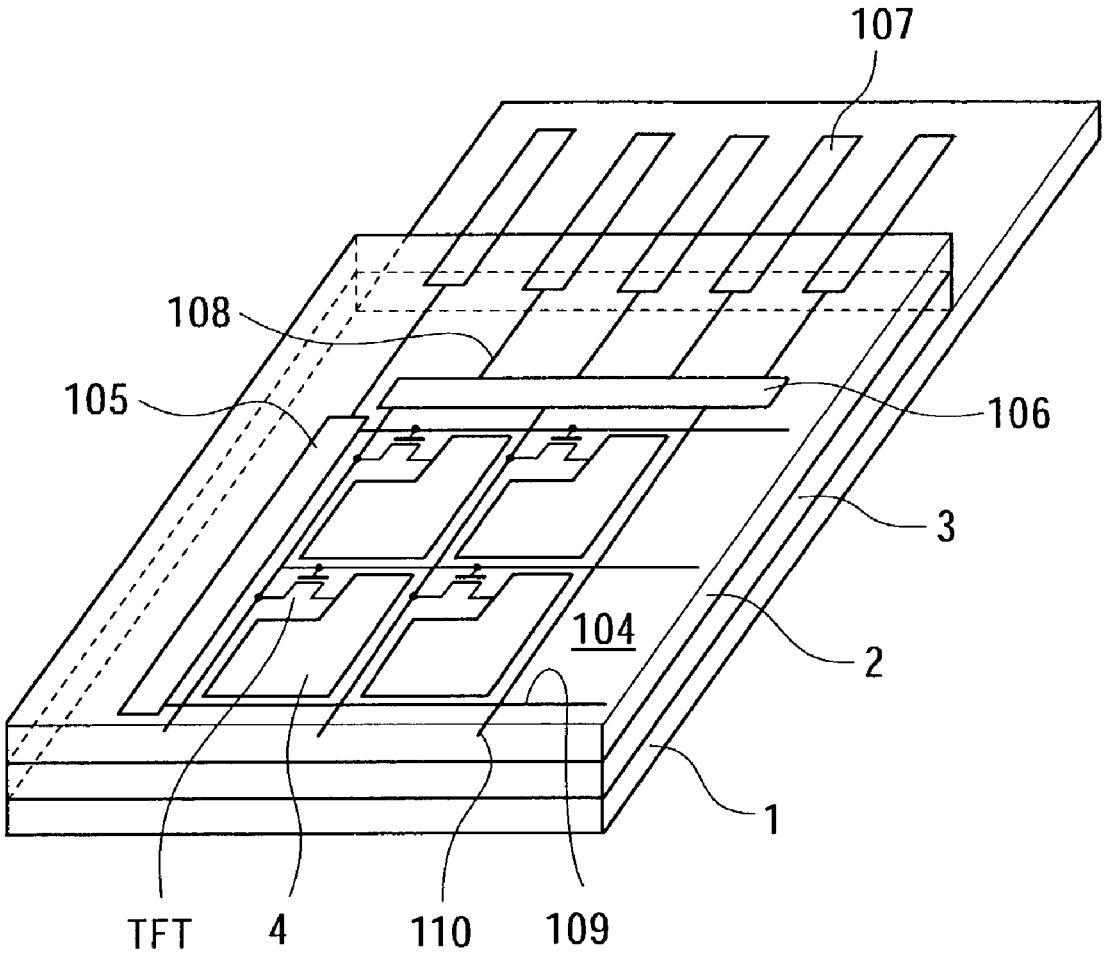
FIG. 9 is a schematic perspective view showing the overall configuration of the liquid-crystal display device according to the present invention.

Finally, FIG. 9 is a schematic perspective view showing the overall configuration of the liquid-crystal display device according to the present invention. As shown in FIG. 9, this liquid-crystal display device has a flat construction comprising a pair of glass substrates 1 and 2, and a liquid crystal 3 held therebetween. On the glass substrate 1 at the lower side, a pixel array section 104 and a driving circuit section are formed in an integrated manner. The driving circuit section is divided into a vertical driving circuit 105 and a horizontal driving circuit 106. Furthermore, at the upper end of the peripheral portion of the substrate 1, a connector section 107 for external connection is formed. The connector section 107 is connected to the vertical driving circuit 105 and the driving circuit 106 via wiring lines 108. The pixel array section 104 is formed with gate wiring lines 109 formed in rows and signal wiring lines 110 formed in columns. The pixel electrodes 4 and the thin-film transistors TFTs for driving the pixel electrodes 4 are formed at the intersection of both the wiring lines. The gate electrode of each TFT is connected to the corresponding gate wiring line 109, the drain region thereof is connected to the corresponding pixel electrode 4, and the source region thereof is connected to the corresponding signal wiring line 110. The gate wiring lines 109 are connected to the vertical driving circuit 105, and the signal wiring lines 110 are connected to the driving circuit 106. On the other hand, on the inner surface of the glass substrate 2 at the upper side, an opposing electrode (not shown) is arranged to face each pixel electrode 4. In such a configuration, a driving section including the vertical driving circuit 105 and the horizontal driving circuit 106 can selectively control the voltage to be applied to the liquid crystal 3 between a voltage equal to or higher than a threshold value and a voltage lower than the threshold value, and a two-gradation display using bistability and a multi-gradation display using a normal response characteristic are made.

What is claimed is:

1. A liquid-crystal display device comprising:

a panel having a flat construction and comprised of a pair of substrates bonded together with a predetermined spacing therebetween and a nematic liquid crystal held in the spacing, one of the substrates having pixel electrodes arranged in a matrix and switching elements for driving the pixel electrodes formed thereon, and the other substrate having opposing electrodes facing the corresponding pixel electrodes formed thereon; and a driving circuit for driving each switching element in order to write a signal to each pixel electrode, and for applying a voltage corresponding to the signal between the opposing electrode and the pixel electrode to control the transmittance of the liquid crystal, wherein the orientation of said liquid crystal is controlled by the pair of substrates in such a manner that a liquid crystal exhibits bistability such that bistable states having different transmittances are provided and both states are capable of existing when no voltage is applied and wherein the state can be switched when a voltage exceeding a predetermined threshold value is applied, and the liquid crystal exhibits a continuous response characteristic in which the transmittance changes continuously in response to an applied voltage in a range which does not exceed the threshold value and wherein the liquid crystal does not exhibit a memory effect in such a range, and wherein said driving circuit selectively controls which of two modes each pixel operates in, a two-gradation display mode using the bistability or a multi-gradation display mode using the continuous response characteristic in which no memory effect is present.

2. A liquid-crystal display device according to claim 1, wherein the orientation control of the liquid crystal is performed by said pair of substrates by making the anchoring strengths thereof with respect to the liquid crystal differ from each other, thus imparting bistability to the liquid crystal.

3. A liquid-crystal display device according to claim 1, wherein the orientation control of the liquid crystal is performed by said pair of substrates by processing the surfaces thereof in contact with the liquid crystal so as to be different from each other, thus imparting bistability to the liquid crystal.

4. A liquid-crystal display device according to claim 1, wherein the orientation control of the liquid crystal is performed by said pair of substrates by forming different orientation films on the surfaces thereof in contact with the liquid crystal, thus imparting bistability to the liquid crystal.

5. A liquid-crystal display device according to claim 1, wherein said driving circuit switches the electrical potential of the opposing electrode in order to selectively control a voltage to be applied to the liquid crystal between a voltage equal to or higher than a threshold value and a voltage lower than the threshold value.

6. A liquid-crystal display device according to claim 1, wherein said driving circuit switches the amplitude of a signal to be written into the pixel electrode in order to selectively control the voltage to be applied to the pixel electrode between a voltage equal to or higher than a threshold value and a voltage lower than the threshold value.

7. A liquid-crystal display device according to claim 1, wherein a phase orientation orientation of said nematic liquid crystal is controlled in the horizontal direction by said pair of substrates.

8. A liquid-crystal display device according to claim 7, wherein said liquid crystal shows a twisted nematic phase in which the orientation is twisted between said pair of substrates.

* * * * *